US006295681B1

(12) United States Patent
Dolah

(10) Patent No.: US 6,295,681 B1
(45) Date of Patent: Oct. 2, 2001

(54) ROTARY BRUSH CLEANING DEVICE

(76) Inventor: Olga H. Dolah, 65 83rd St., Brooklyn, NY (US) 11209

( * ) Notice: Subject to any disclaimer, the term of this patent is extended or adjusted under 35 U.S.C. 154(b) by 0 days.

(21) Appl. No.: 09/469,734

(22) Filed: Dec. 21, 1999

(51) Int. Cl.[7] ..... A47L 17/00

(52) U.S. Cl. ..... 15/22.1; 15/23; 15/65; 15/101

(58) Field of Search ..... 15/22.1, 23, 28, 15/59, 65, 69, 74, 75, 101

(56) References Cited

U.S. PATENT DOCUMENTS

| | | | | |
|---|---|---|---|---|
| D. 233,644 | | 11/1974 | Montesi . | |
| 2,583,577 | | 1/1952 | Kingsbury . | |
| 2,749,909 | | 6/1956 | Ullery et al. . | |
| 3,164,183 | | 1/1965 | Kirkpatrick . | |
| 3,618,208 | | 11/1971 | Cronheim . | |
| 3,780,435 | | 12/1973 | Farha et al. . | |
| 4,137,588 | * | 2/1979 | Sandt et al. | 15/23 |
| 5,353,461 | * | 10/1994 | Enriquez | 15/23 |
| 5,697,115 | * | 12/1997 | Sciarra et al. | 15/28 |
| 5,781,955 | * | 7/1998 | Hendricks | 15/22.1 |
| 5,852,875 | | 12/1998 | Dolah . | |
| 5,870,790 | * | 2/1999 | Root et al. | 15/28 |
| 6,014,462 | * | 3/2000 | Marques | 15/28 |
| 6,170,107 | * | 1/2001 | George et al. | 15/28 |

* cited by examiner

*Primary Examiner*—Terrence R. Till

(57) ABSTRACT

A rotary brush cleaning device with interchangeable brush attachments including a power unit adapted for being held in a hand of a user. The power unit comprises a housing adapted for being gripped in the hand of a user, and the housing has an interior. A motor is mounted in the interior of the housing. An attachment mounting member is located in the interior of the housing, and a power source is located in the housing. At least one interchangeable brush attachment is provided for removably coupling to the power unit. The brush attachment includes a brush portion and an attachment base portion for removably mounting to the attachment mounting member of the power unit. The attachment mounting member has a mounting groove formed by an inner wall surface and an outer wall surface spaced from the inner wall surface. The mounting groove is substantially annular and peg members are located at diametrically opposite locations on the annular mounting groove. The attachment base portion of the brush attachment has a sleeve portion for insertion into the mounting groove of the attachment mounting member of the power unit. The attachment base portion has an attachment slot for receiving and engaging the peg member of the attachment mounting member. The brush attachments may include a toilet cleaning brush attachment, a bottle cleaning brush attachment, a sponge brush attachment, a baby bottle nipple cleaning brush attachment, a wire brush attachment, and a scouring brush attachment.

22 Claims, 3 Drawing Sheets

ROTARY BRUSH CLEANING DEVICE

BACKGROUND OF THE INVENTION

1. Field of the Invention

The present invention relates to cleaning devices and more particularly pertains to a new rotary brush cleaning device for permitting brush cleaning of a variety of items using a single power unit and a plurality of specialized brush attachments.

2. Description of the Prior Art

The use of cleaning devices is known in the prior art. More specifically, cleaning devices such as brush cleaning devices for single specialized purposes are known in the art. However, in order to have the benefit of a multiplicity of these specialized cleaning devices, one must purchase each of these specialized devices at significant combined cost. Further, upon purchasing all of these specialized devices, significant storage area must be dedicated to storing all of the specialized devices. Still further, maintaining each of the devices and toting the devices around the house during cleaning chores pose further challenges to the use of these individual devices.

While the devices of the prior art fulfill their respective, particular objectives and requirements, the aforementioned specialized devices do not disclose a new rotary brush cleaning device.

SUMMARY OF THE INVENTION

In view of the foregoing disadvantages inherent in the known types of cleaning devices now present in the prior art, the present invention provides a new rotary brush cleaning device construction wherein the same can be utilized for permitting brush cleaning of a variety of items using a single power unit and a plurality of specialized brush attachments.

The new rotary brush cleaning device of the present invention generally comprises a power unit adapted for being held in a hand of a user. The power unit comprises a housing adapted for being gripped in the hand of a user, and the housing has an interior. A motor is mounted in the interior of the housing. An attachment mounting member is located in the interior of the housing, and a power source is located in the housing. At least one interchangeable brush attachment is provided for removably coupling to the power unit. The brush attachment includes a brush portion and an attachment base portion for removably mounting to the attachment mounting member of the power unit. The attachment mounting member has a mounting groove formed by an inner wall surface and an outer wall surface spaced from the inner wall surface. The mounting groove is substantially annular and peg members are located at diametrically opposite locations on the annular mounting groove. The attachment base portion of the brush attachment has a sleeve portion for insertion into the mounting groove of the attachment mounting member of the power unit. The attachment base portion has an attachment slot for receiving and engaging the peg member of the attachment mounting member. The brush attachments may include a toilet cleaning brush attachment, a bottle cleaning brush attachment, a sponge brush attachment, a baby bottle nipple cleaning brush attachment, a wire brush attachment, and a scouring brush attachment.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new rotary brush cleaning device apparatus which has many of the advantages of the cleaning devices mentioned heretofore and many novel features that result in a new rotary brush cleaning device which is not anticipated, rendered obvious, suggested, or even implied by any of the prior art cleaning devices, either alone or in any combination thereof.

It is another object of the present invention to provide a new rotary brush cleaning device which may be easily and efficiently manufactured and marketed.

It is a further object of the present invention to provide a new rotary brush cleaning device which is of a durable and reliable construction.

An even further object of the present invention is to provide a new rotary brush cleaning device which is susceptible of a low cost of manufacture with regard to both materials and labor, and which accordingly is then susceptible of low prices of sale to the consuming public, thereby making such rotary brush cleaning device economically available to the buying public.

Still yet another object of the present invention is to provide a new rotary brush cleaning device which provides in the apparatuses and methods of the prior art some of the advantages thereof, while simultaneously overcoming some of the disadvantages normally associated therewith.

Still another object of the present invention is to provide a new rotary brush cleaning device for permitting brush cleaning of a variety of items using a single power unit and a plurality of specialized brush attachments.

Yet another object of the present invention is to provide a new rotary brush cleaning device which provides specialized cleaning implements including a toilet cleaning brush attachment, a bottle cleaning brush attachment, a sponge brush attachment, a baby bottle nipple cleaning brush attachment, a wire brush attachment, and a scouring brush attachment.

Still yet another object of the present invention is to provide a new rotary brush cleaning device that provides the ability to clean a variety of household objects using the specialized brush attachments without having to employ a multiplicity of other cleaning devices.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
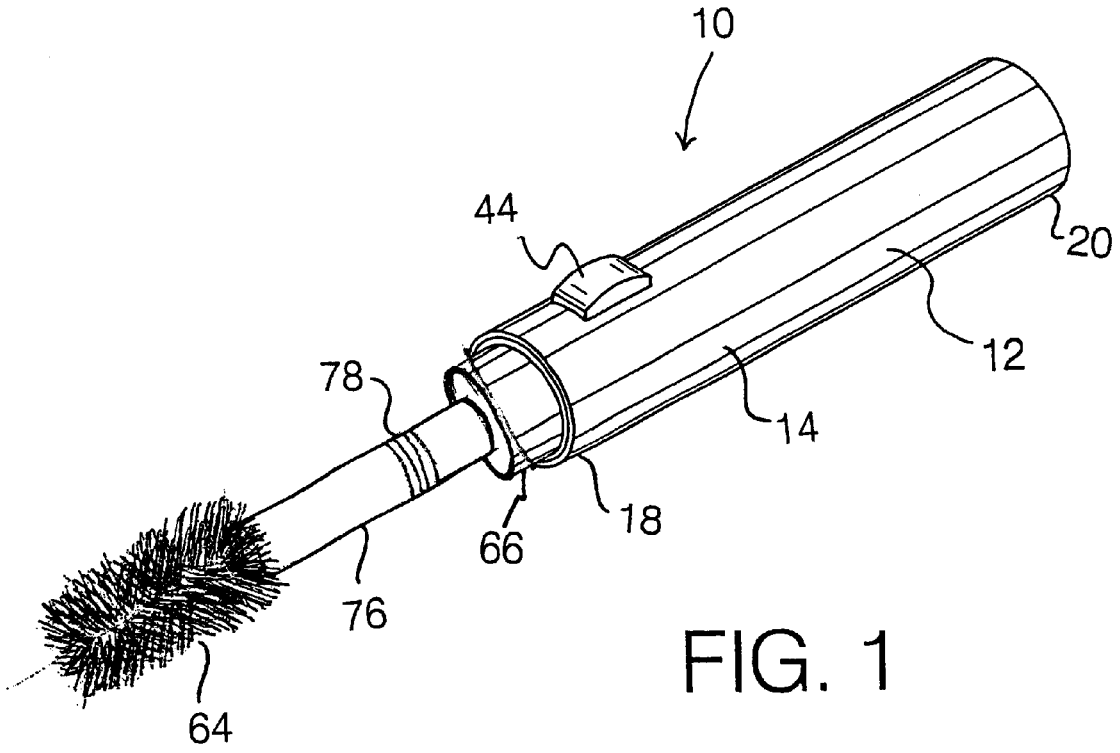
FIG. 1 is a schematic perspective view of a new rotary brush cleaning device according to the present invention.
Figure 2:
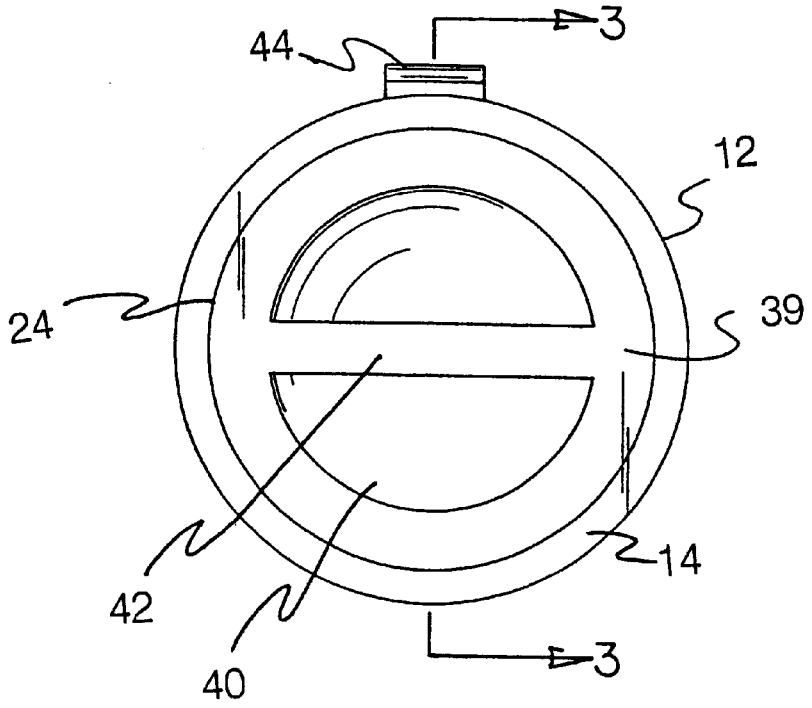
FIG. 2 is a schematic view of the second end of the power unit of the present invention.
Figure 3:
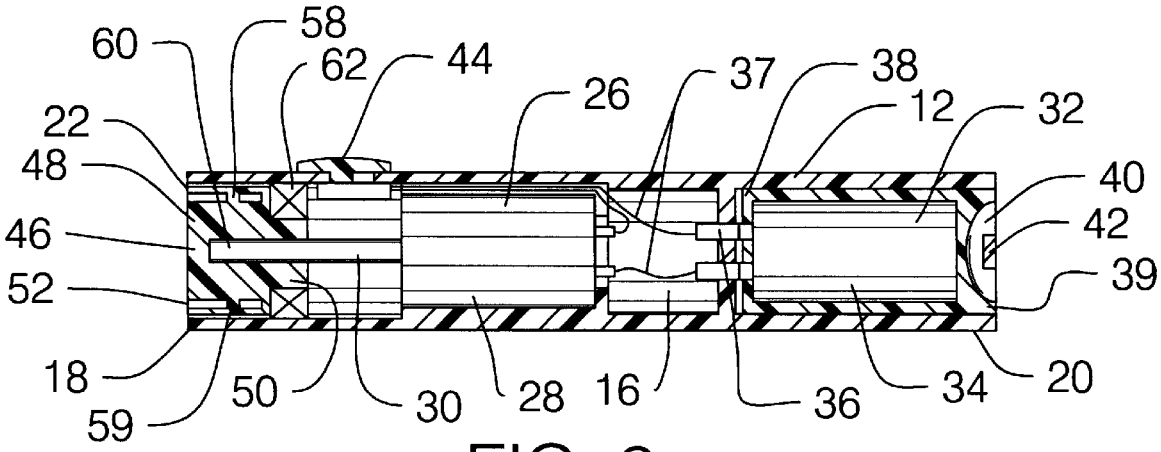
FIG. 3 is a schematic sectional view of the present invention taken along line 3—3 of FIG. 2.
Figure 4:
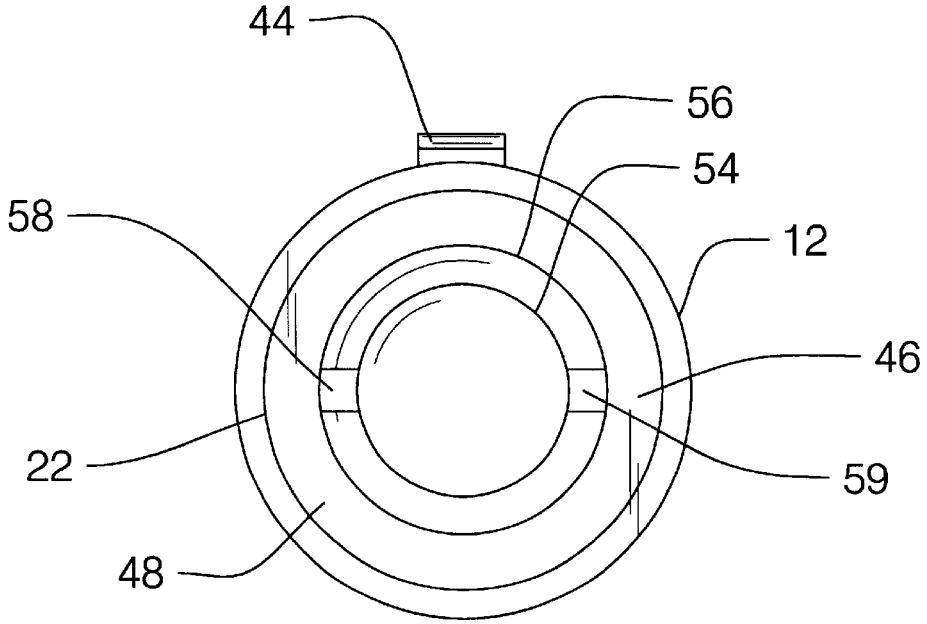
FIG. 4 is a schematic view of the first end of the power unit of the present invention with the brush attachment removed.
Figure 6:
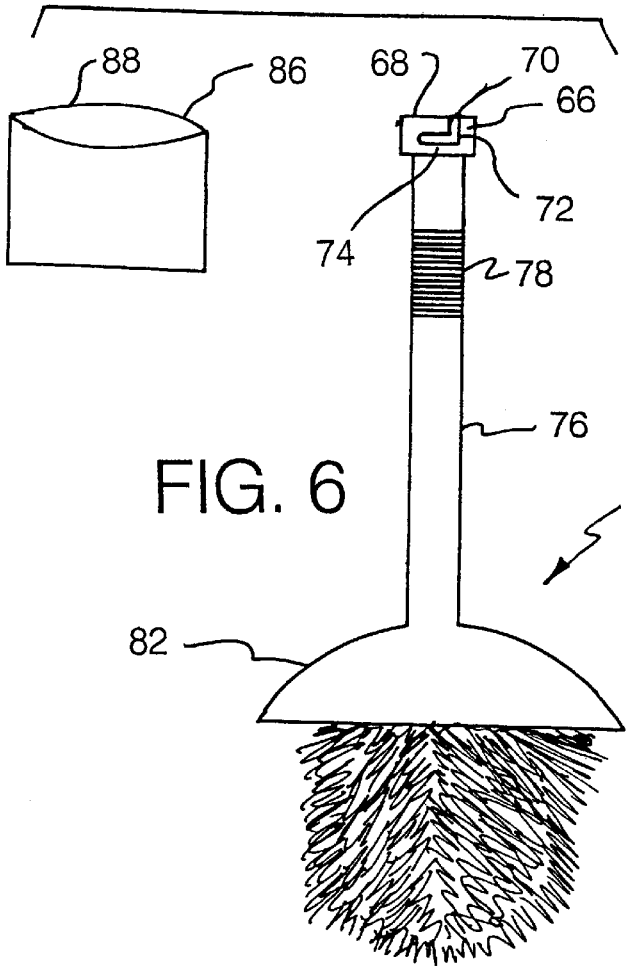
FIG. 6 is a schematic side view of a toilet cleaning brush attachment of the present invention.
Figure 7:
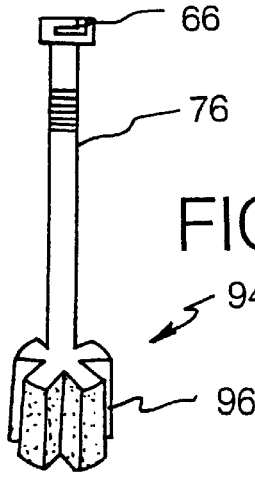
FIG. 7 is a schematic side view of a sponge brush attachment of the present invention.
Figure 8:
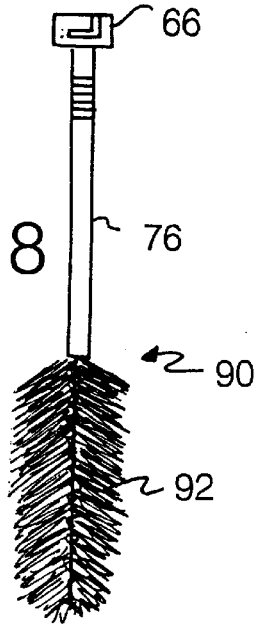
FIG. 8 is a schematic side view of a bottle cleaning brush attachment of the present invention.
Figure 9:
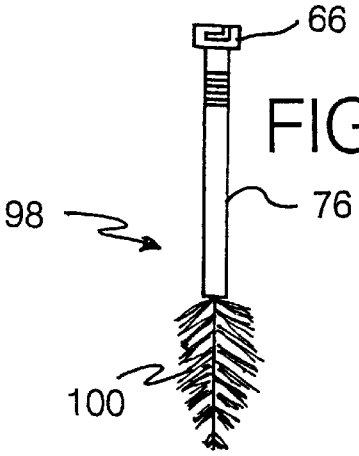
FIG. 9 is a schematic side view of a baby bottle nipple toilet cleaning brush attachment of the present invention.
Figure 10:
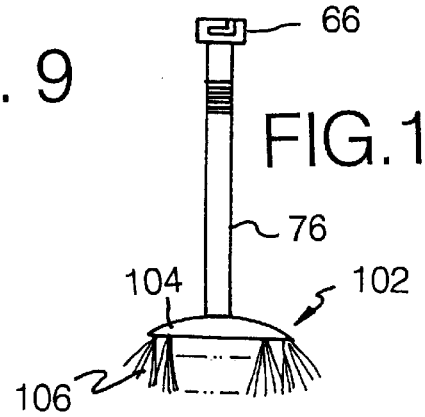
FIG. 10 is a schematic side view of a wire brush attachment of the present invention.
Figure 5:
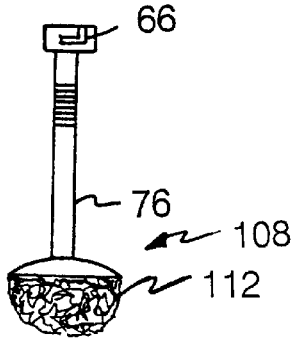
FIG. 5 is a schematic side view of a scouring brush attachment of the present invention.

With reference now to the drawings, and in particular to FIGS. 1 through 10 thereof, a new rotary brush cleaning device embodying the principles and concepts of the present invention and generally designated by the reference numeral 10 will be described.

As best illustrated in FIGS. 1 through 10, the rotary brush cleaning device 10 generally comprises a power unit 12 adapted for being held in a hand of a user and a plurality of interchangeable brush attachments for removably coupling to the power unit.

The power unit of the invention generally comprises a housing 14 adapted for being gripped in the hand of a user during use. The housing has an interior 16, and a first end 18 and a second end 20. The first end has a first opening 22 into the interior of the housing, and the second end has a second opening 24 into the interior of the housing.

A motor 26 is mounted in the interior of the housing. The motor has a motor case 28 with a rotating shaft 30 extending out of the motor case. The rotating shaft of the motor extends toward the first opening of the housing.

A power source 32 is located in the housing. The power source may be preferably removably mounted in the interior of the housing, and is preferably removably insertable through the second end of the housing. The power source has a power source case 34 with a pair of electrical contacts 36 on a first end 38 of the power source case. A pair of wires 37 connects the electrical contacts to the motor.

A second end 39 of the power source case has a recess 40 formed therein. The recess has an arcuate concave surface, and a bar 42 extends across the recess of the second end of the power source case for permitting finger pinching of the bar when pulling the power source case from the housing. The power source may comprise a rechargeable battery that is removably mounted in the housing, although the rechargeable battery may be permanently mounted in the housing. Optionally, the power source may comprise a replaceable battery.

A power switch 44 may be provided for selectively permitting electrical power flow from the power source to the motor. The power source switch is mounted on the housing, and has a portion located on an exterior of the housing for being actuated by a finger of the user.

An attachment mounting member 46 is provided for coupling to a brush attachment. The attachment mounting member has a mounting end 48 and an interior end 50. A mounting groove 52 is formed on the mounting end of the attachment mounting member. The mounting groove is formed by an inner wall surface 54 and an outer wall surface 56 that is spaced from the inner wall surface. A pair of peg members 58, 59 each extend from the inner wall surface to the outer wall surface. The mounting groove preferably may be substantially annular with the peg members being located at diametrically opposite locations on the annular mounting groove.

The interior end of the attachment mounting member has a bore 60 therein, and the bore receives a free end of the rotating shaft of the motor. A bearing 62 is mounted between the attachment mounting member and an interior surface of the housing for permitting smooth rotation of the attachment mounting member in the housing.

Each of the brush attachments comprises a brush portion 64 and an attachment base portion 66 for removably mounting to the attachment mounting member of the power unit. The brush portion is mounted to the attachment base portion. The attachment base portion has a sleeve portion 68 for insertion into the mounting groove of the attachment mounting member of the power unit. The attachment base portion is preferably provided with an attachment slot 70 for receiving and engaging each of the peg members of the attachment mounting member. The attachment slot has an entry portion 72 extending in the longitudinal direction of the brush attachment. Further, the attachment slot has a locking portion 73 extending substantially perpendicular to the longitudinal direction of the entry portion. Rotation of the attachment base portion about the longitudinal axis of the brush attachment moves the peg member received in the entry portion of the attachment slot into the locking portion of the attachment slot for providing a positive locking of the brush attachment to the attachment mounting member of the power unit by resisting longitudinal movement of the brush attachment.

Each of the brush attachments also preferably includes an elongate intermediate shaft 76 extending between the attachment base and the brush portion. Ideally, an exterior surface of the intermediate shaft has a plurality of annular grooves 78 for facilitating finger gripping of the intermediate shaft for pulling the attachment base of the brush attachment from the attachment mounting member when interchanging brush attachments.

A first brush attachment comprises a toilet cleaning brush attachment 80. The toilet cleaning brush preferably includes a splash shield 82 mounted on the intermediate shaft at a location adjacent to adjacent to the brush portion to block splashing of liquid from the brush portion toward the attachment base. The splash shield may have a concave surface toward the brush portion and a convex surface toward the attachment base.

A plurality of bristles 84 are mounted to a central shaft of the brush portion. The bristles preferably define an outer diameter smaller than an outer diameter of the splash shield.

Optionally, the intermediate shaft may have a length about twice a length of the central shaft of the toilet cleaning brush attachment. As a further option, the plurality of bristles may have a diameter about four times a diameter of the intermediate shaft.

A toilet brush receptacle 86 may be provided having an interior for receiving the brush portion of the toilet cleaning brush attachment. The toilet brush receptacle preferably has an upper rim 88 adapted for resting the splash shield of the toilet cleaning brush attachment so that the attachment is maintained in an upstanding position and the receptacle catches any liquids dripping off of the brush portion.

A second brush attachment comprises a bottle cleaning brush attachment 90. The bottle cleaning brush attachment has a brush portion with a plurality of bristles 92 mounted to a central shaft of the brush portion. The central shaft of the brush portion may have a length substantially equal to a length of the intermediate shaft.

A third brush attachment comprises a sponge brush attachment 94. The sponge brush attachment comprises a plurality of radially-extending sponge arms 96 mounted to the central shaft. A central shaft of the brush portion may have a length about one-third of a length of the intermediate shaft. The plurality of sponge arms may comprise five sponge arms, and each of the sponge arms may have a rectangular cross section.

A fourth brush attachment comprises a baby bottle nipple cleaning brush attachment 98. The baby bottle nipple cleaning brush attachment comprises a plurality of bristles 100 mounted to a central shaft of the brush portion. The plurality of bristles has a diameter that tapers smaller toward a free end of the central shaft. The central shaft of the brush portion has a length about half of a length of the intermediate shaft.

A fifth brush attachment comprises a wire brush attachment 102. The wire brush attachment comprises a bristle mounting flange 104 mounted to the intermediate shaft opposite the attachment base. The bristle mounting flange extends outwardly from the intermediate flange. Optionally, the bristle mounting flange may have a diameter about four times a diameter of the intermediate shaft. A plurality of wire bristles 106 is mounted to the mounting flange, with the wire bristles extending generally parallel to the intermediate shaft. Optionally, the bristles may have a length about one-fourth a length of the intermediate shaft.

A sixth brush attachment comprises a scouring brush attachment 108. The scouring brush attachment comprises a mounting flange 110 mounted to the intermediate shaft opposite the attachment base. The mounting flange extends outwardly from the intermediate shaft. Optionally, the mounting flange may have a diameter about three times a diameter of the intermediate shaft. A scouring brush filament 112 is mounted to the mounting flange. The scouring brush filament extends in a generally serpentine and random direction.

In use, the brush attachments may be interchangeably attached to the power unit as various cleaning chores are addressed. The need for a plurality of specialized devices is fulfilled by a single power unit and a plurality of specialized brush attachments.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A rotary brush cleaning system with interchangeable brush attachments, comprising:

a power unit adapted for being held in a hand of a user, the power unit comprising:

a housing adapted for being gripped in the hand of a user, the housing having an interior;

a motor mounted in the interior of the housing;

an attachment mounting member located in the interior of the housing;

a power source located in the housing; and at least one interchangeable brush attachment for removably coupling to the power unit, the at least one brush attachment including a brush portion and an attachment base portion mounted to the attachment base portion for removably mounting to the attachment mounting member of the power unit;

wherein the attachment mounting member has a mounting groove formed by an inner wall surface and an outer wall surface spaced from the inner wall surface.

2. The rotary brush cleaning system of claim 1 wherein the power source is removably mounted in the interior of the housing, the power source having a power source case removably insertable through a second opening in a second end of the housing.

3. The rotary brush cleaning system of claim 2 wherein a second end of the power source case has a recess formed therein, and a bar extending across the recess of the second end of the power source case for permitting finger pinching of the bar to pull the power source case from the housing.

4. The rotary brush cleaning system of claim 1 additionally comprising a pair of peg members each extending from the inner wall surface to the outer wall surface.

5. The rotary brush cleaning system of claim 4 wherein the mounting groove is substantially annular and the peg members are located at diametrically opposite locations on the annular mounting groove.

6. The rotary brush cleaning system of claim 1 wherein the attachment base portion of the brush attachment has a sleeve portion for insertion into the mounting groove of the attachment mounting member of the power unit.

7. The rotary brush cleaning system of claim 6 wherein the attachment base portion has an attachment slot for receiving and engaging the peg member of the attachment mounting member.

8. The rotary brush cleaning system of claim 7 wherein the attachment slot has an entry portion extending in the longitudinal direction of the brush attachment and a locking portion extending substantially perpendicular to the longitudinal direction of the entry portion such that rotation of the attachment base portion about the longitudinal axis moves one of the peg members received in the entry portion of the attachment slot into the locking portion of the attachment slot.

9. The rotary brush cleaning system of claim 1 wherein the brush attachment includes an elongate intermediate shaft extending between the attachment base and a central shaft of the brush portion.

10. The rotary brush cleaning system of claim 9 wherein an exterior surface of the intermediate shaft has a plurality of annular grooves for facilitating finger gripping of the intermediate shaft for pulling the attachment base from the attachment mounting member.

11. The rotary brush cleaning system of claim 1 wherein the brush attachment comprises a toilet cleaning brush attachment, the toilet cleaning brush attachment comprising a splash shield mounted on the intermediate shaft adjacent to the brush portion to block splashing of liquid from the brush portion toward the attachment base, and a plurality of bristles mounted to the central shaft.

12. The rotary brush cleaning system of claim 11 additionally comprising a toilet brush receptacle having an interior for receiving the brush portion of the toilet cleaning brush attachment, the toilet brush receptacle having an upper rim adapted for resting the splash shield of the toilet cleaning brush attachment.

13. The rotary brush cleaning system of claim 1 wherein the brush attachment comprises a bottle cleaning brush attachment, the bottle cleaning brush attachment includes a plurality of bristles mounted to a central shaft of the brush portion.

14. The rotary brush cleaning system of claim 1 wherein the brush attachment comprises a sponge brush attachment, the sponge brush attachment including a plurality of radially-extending sponge arms mounted to the central shaft.

15. The rotary brush cleaning system of claim 1 wherein the brush attachment comprises a baby bottle nipple cleaning brush attachment, the baby bottle nipple cleaning brush attachment including a plurality of bristles mounted to the central shaft, the plurality of bristles having a diameter that tapers smaller toward a free end of the central shaft.

16. The rotary brush cleaning system of claim 1 wherein the brush attachment comprises a wire brush attachment, the wire brush attachment including a bristle mounting flange mounted to the intermediate shaft opposite the attachment base, the bristle mounting flange extending outwardly from the intermediate shaft, and a plurality of wire bristles mounted to the mounting flange, the wire bristles extending generally parallel to the intermediate shaft.

17. The rotary brush cleaning system of claim 1 wherein the brush attachment comprises a scouring brush attachment, the scouring brush attachment including a mounting flange mounted to the intermediate shaft opposite the attachment base, the mounting flange extending outward from the intermediate flange, and a scouring brush filament mounted to the mounting flange.

18. A rotary brush cleaning system with interchangeable brush attachments, comprising:

a power unit adapted for being held in a hand of a user, the power unit comprising:

a housing adapted for being gripped in the hand of a user, the housing having an interior;

a motor mounted in the interior of the housing;

an attachment mounting member located in the interior of the housing;

a power source located in the housing;

at least one interchangeable brush attachment for removably coupling to the power unit, the at least one brush attachment including a brush portion and an attachment base portion mounted to the attachment base portion for removably mounting to the attachment mounting member of the power unit;

wherein the power source is removably mounted in the interior of the housing, the power source having a power source case removably insertable through a second opening in a second end of the housing; and wherein a second end of the power source case has a recess formed therein, and a bar extending across the recess of the second end of the power source case for permitting finger pinching of the bar to pull the power source case from the housing.

19. A rotary brush cleaning system with interchangeable brush attachments, comprising:

a power unit adapted for being held in a hand of a user, the power unit comprising:

a housing adapted for being gripped in the hand of a user, the housing having an interior;

a motor mounted in the interior of the housing;

an attachment mounting member located in the interior of the housing;

a power source located in the housing; and at least one interchangeable brush attachment for removably coupling to the power unit, the at least one brush attachment including a brush portion and an attachment base portion mounted to the attachment base portion for removably mounting to the attachment mounting member of the power unit;

wherein the brush attachment includes an elongate intermediate shaft extending between the attachment base and a central shaft of the brush portion; and wherein an exterior surface of the intermediate shaft has a plurality of annular grooves for facilitating finger gripping of the intermediate shaft for pulling the attachment base from the attachment mounting member.

20. A rotary brush cleaning system with interchangeable brush attachments, comprising:

a power unit adapted for being held in a hand of a user, the power unit comprising:

a housing adapted for being gripped in the hand of a user, the housing having an interior;

a motor mounted in the interior of the housing;

an attachment mounting member located in the interior of the housing;

a power source located in the housing; and at least one interchangeable brush attachment for removably coupling to the power unit, the at least one brush attachment including a brush portion and an attachment base portion mounted to the attachment base portion for removably mounting to the attachment mounting member of the power unit;

wherein the brush attachment comprises a toilet cleaning brush attachment, the toilet cleaning brush attachment comprising a splash shield mounted on the intermediate shaft adjacent to the brush portion to block splashing of liquid from the brush portion toward the attachment base, and a plurality of bristles mounted to the central shaft.

21. The rotary brush cleaning system of claim 20 additionally comprising a toilet brush receptacle having an interior for receiving the brush portion of the toilet cleaning brush attachment, the toilet brush receptacle having an upper rim adapted for resting the splash shield of the toilet cleaning brush attachment.

22. A rotary brush cleaning system with interchangeable brush attachments, comprising:

a power unit adapted for being held in a hand of a user, the power unit comprising:

a housing adapted for being gripped in the hand of a user, the housing having an interior;

a motor mounted in the interior of the housing;

an attachment mounting member located in the interior of the housing;

a power source located in the housing; and at least one interchangeable brush attachment for removably coupling to the power unit, the at least one brush attachment including a brush portion and an attachment base portion mounted to the attachment base portion for removably mounting to the attachment mounting member of the power unit;

wherein the brush attachment comprises a sponge brush attachment, the sponge brush attachment including a plurality of radially-extending sponge arms mounted to the central shaft.

* * * * *